US006364617B1

(12) United States Patent
Riske et al.

(10) Patent No.: US 6,364,617 B1
(45) Date of Patent: Apr. 2, 2002

(54) TOOLLESS ASSEMBLED FAN

(75) Inventors: Stanley J. Riske, Hanover; Christopher M. Riske, Jackson, both of MI (US)

(73) Assignee: Airmaster Fan Company, Jackson, MI (US)

( * ) Notice: Subject to any disclaimer, the term of this patent is extended or adjusted under 35 U.S.C. 154(b) by 0 days.

(21) Appl. No.: 09/494,463

(22) Filed: Jan. 31, 2000

(51) Int. Cl.[7] ..... F04D 25/08

(52) U.S. Cl. ..... 416/246; 416/244 R; 416/247 R; 411/400; 411/402; 411/87; 411/919

(58) Field of Search ..... 416/244 R, 246, 416/204 R, 247 R; 248/125.7, 538, 220.41, 220.43, 221.11, 130, 291.1, 292.12; 411/400, 402, 408, 409, 410, 87, 88, 919; 454/338, 257

(56) References Cited

U.S. PATENT DOCUMENTS 1,373,087 A * 3/1921 Leyerer ..... 248/88
1,725,790 A * 8/1929 Halagarda ..... 411/87
3,570,793 A * 3/1971 Shackel ..... 248/515
3,606,450 A * 9/1971 Sedgwick ..... 248/283.1
4,235,409 A * 11/1980 Cummings ..... 248/515
4,493,225 A * 1/1985 Galahad ..... 411/402
5,927,681 A * 7/1999 Ovelman ..... 248/682
6,145,798 A * 11/2000 Janisse et al. ..... 248/324

FOREIGN PATENT DOCUMENTS

JP 06-167298 * 6/1994
JP 11-311200 * 11/1999

* cited by examiner

*Primary Examiner*—Edward K. Look
*Assistant Examiner*—Richard Woo
(74) *Attorney, Agent, or Firm*—Young & Basile, P.C.

(57) ABSTRACT

An air circulating fan wherein the fan components are shipped disassembled. All of the fasteners used to assemble the fan components may be operated without tools, utilizing thumb screws and the like wherein the fan is capable of a "toolless" assembly. A hand operated fan mounting clamp includes a safety device to prevent loosening due to vibration.

4 Claims, 2 Drawing Sheets

TOOLLESS ASSEMBLED FAN

BACKGROUND OF THE INVENTION

1. Field of the Invention

The invention pertains to air circulating fans wherein the fan components are shipped disassembled and require assembly prior to use.

2. Description of the Related Art

Air circulating fans, particularly of the larger size, are bulky to ship. Such fans include an electric motor, a blade which is to be mounted upon the motor drive shaft, a blade guard, and a fan support which may constitute a column having a base if the fan is to be floor supported, or the support may comprise a bracket for attachment to ceiling or wall structure.

It is normally necessary to ship the fan components in a knockdown or disassembled condition in order to meet the package size requirements of shippers, for instance United Parcel Service, and the shipping of disassembled fan components is common and single carton packages have been developed as shown in U.S. Pat. No. 4,953,698.

The customer receiving the fan in the disassembled condition is provided with instructions for assembling the various components, and such assembly normally requires wrenches and screwdrivers of several sizes for tightening nuts and screws. Accordingly, the recipient of a disassembled fan is required to have access to the various tools necessary to assemble the fan components.

OBJECTS OF THE INVENTION

It is an object of the invention to provide an air circulating fan which is shipped in a knockdown condition, the various major components being disassembled, wherein such major components may be operably assembled to each other without requiring tools, assembly being accomplished only by use of the hands and fingers.

A further object of the invention is to provide an air circulating fan wherein the components thereof are shipped in a disassembled manner and wherein the components can be assembled by hand requiring no tools, and wherein critical hand assembly of support components are effectively locked to prevent loosening due to operational vibration.

SUMMARY OF THE INVENTION

An air circulating fan using the concepts of the invention may be of the commercial type such as used in factories, barns, and in large spaces wherein significant air circulation is required. However, the concepts can be used with any size of fan wherein the components are shipped in a knockdown or disassembled manner to minimize the dimensions of shipping cartons.

Basically, air circulating fans of the blade type include an electric motor having a drive shaft on which the blade or propeller is mounted. A blade guard surrounds the blade for safety purposes. The electric motor is mounted on either a floor supported column, or upon a support bracket which is attached to ceiling or wall structure. Also, it is common to attach the electric motor to its support structure in such a manner as to permit an angular adjustment between the motor and support in order to direct the air stream most effectively.

The front end of the motor housing, the end from which the motor drive shaft extends, is provided with threaded studs extending parallel to the drive shaft. The blade guard is usually of two parts, the rear part attaching to the motor housing, while the front part hinges to the rear guard portion, the blade or propeller being located between the grill front and rear portions.

In the practice of the invention, thumb nuts are used to mount the guard rear portion upon the threaded studs extending from the motor. In this manner, by firmly finger tightening the thumb nuts, the grill rear portion is firmly attached to the fan motor. The grill front portion is usually hinged to the grill rear portion so as to permit the grill front portion to be opened relative to the rear portion providing access to the blade or propeller for blade installation or blade cleaning purposes.

The blade mounts upon the electric motor drive shaft, and the blade is mounted on the drive shaft by a left handed threaded wing nut or thumb nut. In this manner, the blade can be mounted upon the motor drive shaft without the use of tools.

The front grill portion is hinged to the rear grill, and the hinge components which lock the grill portions together are all operable by hand requiring no tools.

The electric motor housing is either floor supported or attached to the ceiling or a wall. If floor mounted, the electric motor will be mounted upon a column having a base, and the column may consist of telescoping portions which are fastened together by wing nuts. If the electric motor is mounted on the ceiling or wall, the motor support bracket is attached to the support structure by U-bolts having hand operated nuts, and a safety connector interposed between the U-bolt nuts prevents the nuts from turning due to operational vibration.

The electric motor is mounted to its support structure by a pivot bolt wherein the angular relationship of the motor to its support can be adjusted. A pin mounted upon the bolt extends through holes defined in the support structure and on the electric motor mounting ear wherein upon alignment of such holes, a pin mounted on the bolt extends therethrough to positively maintain the desired angular relationship of the motor housing to its support.

As all of the disassembled fan components are assembled by wing nuts, thumb nuts or finger operated connectors, all of the components may be assembled in a firm proper manner without the use of tools, simplifying assembly, and eliminating the need for special assembly equipment.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
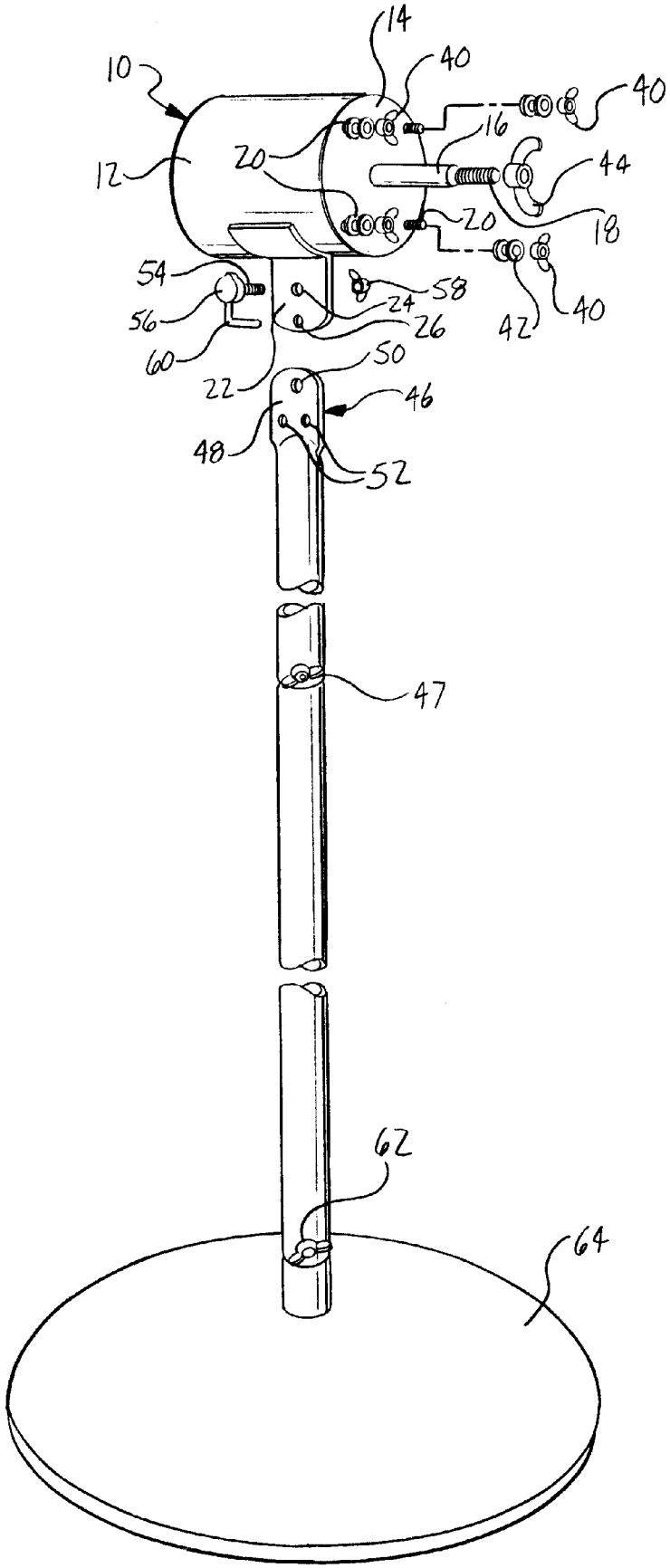
FIG. 1 is a perspective view illustrating the electric motor components in an exploded relationship, and also showing a typical column mounting structure for the motor.

An air circulating fan in accord with the invention is powered by an electric motor 10 which includes a housing 12 having a front end 14, and the motor drive shaft 16 extends from the housing front end. The outer end of the drive shaft is threaded at 18.

Four threaded studs 20 radially disposed with respect to the drive shaft 16 extend from the front face 14 for attachment of the guard to the motor, as later described. A flat ear 22 extends downwardly from the housing 12 for mounting of the housing, and the ear 22 includes a pivot bolt receiving hole 24, and a smaller adjustment hole 26 at a radial distance from the axis of the hole 24.

Figure 2:
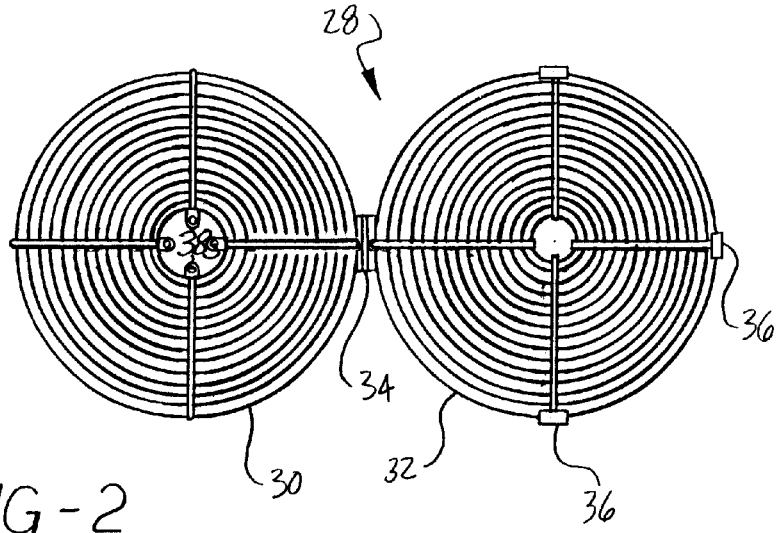
FIG. 2 is a view of the blade guard illustrating the rear and front portions as hinged together.

The blade guard 28 is shown in FIG. 2 and usually consists of a plurality of circles formed of wire welded together to encase the fan blade and prevent injury. The guard 28 is of conventional construction consisting of a rear grill half 30 hinged to a front grill or guard 32 wherein the guard portions are interconnected by a hinge 34. Other connectors 36 are arranged about the periphery of the front grill 32 which are manually operable and are used to attach the grill halves 30 and 32 together to enclose the blade, not shown. A plurality of holes 38 are defined upon the rear grill guard 30 at locations which correspond to the spacing of the motor studs 20. The holes 38 may be defined by bent wire, or may be formed upon plates welded to the wire of the grill half 30.

The guard 28 is assembled to the motor 10 by placing the rear grill 30 upon the motor front end 14 so that the threaded studs 20 extend through the grill holes 38. Thereupon, wing nuts 40 and washers 42 are placed upon the studs 20 and the wing nuts 40 tightened to firmly affix the guard 28 to the motor housing 12.

The fan blade, not shown, which is usually in the form of a propeller, is mounted upon the drive shaft 16, and the blade nut 44 is threaded upon the drive shaft 16. As the drive shaft 16 is provided with a left hand thread, the thread within nut 44 will also be of a left hand, so as not to become unloosened due to the torque exerted on the blade. The nut 44 comprises a large wing nut having thumb engaging portions so that the nut 44 may be hand tightened firmly on the shaft 16 to affix the fan blade on the drive shaft.

Figure 3:
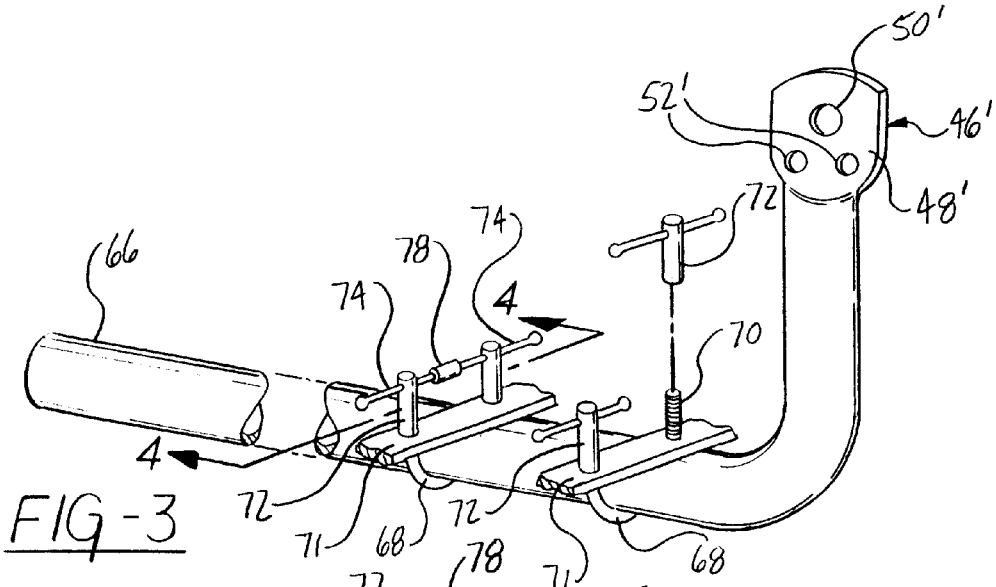
FIG. 3 is a perspective view of a support bracket for supporting the fan to a ceiling or wall structure, a U-bolt type connector being employed.
Figure 4:
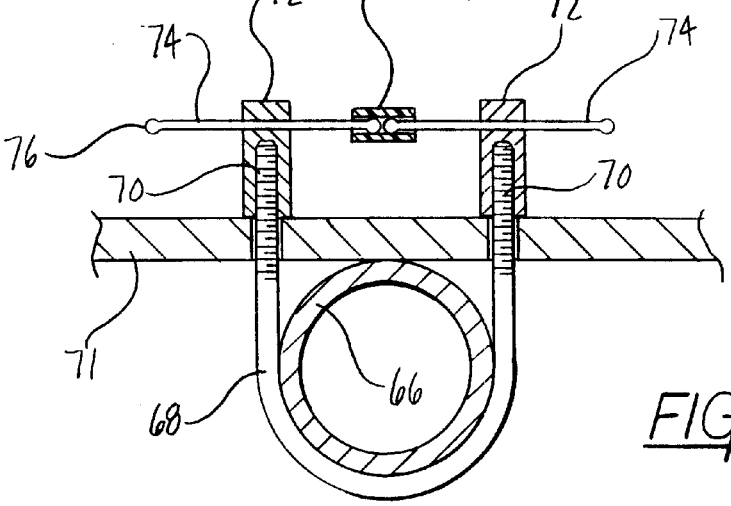
FIG. 4 is a sectional view taken along Section 4—4 of FIG. 3, illustrating the sleeve interconnecting the nut pins.

The fan may be mounted upon a column support, shown in FIG. 1, or a bracket, FIGS. 3 and 4, which is mounted upon the ceiling or a wall. This portion of the fan support 46 is mounted to either its column or bracket by a thumb screw connection 47, and the support 46 is provided with a flat portion 48 having a pivot hole 50 defined therein. Also, a pair of adjustment holes 52 are formed in the flat portion 48 an equal radial distance from the hole 50 corresponding to the distance of the adjustment hole 26 from the ear hole 24.

A pivot bolt 54 having a head 56 extends through the ear hole 24 and the support portion hole 50, and the bolt 54 is maintained in place by the thumb operated wing nut 58a FIG. 1, whereby ear 22 and flat portion 48 are frictionally connected. Preferably, an L-shaped pin 60 is mounted upon the bolt head 56, and includes a portion parallel to the length of the bolt 54 whereby the pin 60 will be received within aligned adjustment holes 26 and 52 when the desired angular relationship between the motor housing 12 and its support 46 is attained and use of pin 60 produces a positive angular locking of ear 22 and support 46.

With reference to FIG. 1, when supporting the motor 10 upon a column, the column may consist of portions affixed together by wing screws 62, and the column base 64 is also attached to the column portions by a wing screw.

When using the ceiling or wall mounting bracket of FIG. 4, where similar components are indicated by primes, an L-shaped tubular bracket 66 is attached to the support 46', and a connector consisting of a U-bolt 68 having threaded ends 70 encompasses the bracket 66, and extends through holes formed in ceiling elements 71. Nuts 72 are threaded upon the U-bolt ends 70, and the nuts 72 are rotated by thumb and finger engaging pins 74 which are longitudinally slidable within their associated nuts 72. The pins 74 include bulbous heads 76, as will be appreciated from FIG. 4.

Accordingly, it will be appreciated that upon tightening of the nuts 72 by hand rotation thereof through the pins 74 that the bracket 66 may be firmly mounted to the ceiling elements 71. In order to prevent the nuts 72 from unloosening due to operational vibration, a nylon tubular sleeve 78 extends between the pins 74, FIG. 4, over the heads 76 of the aligned pins, and the sleeve 78 will prevent rotation of the nuts 72. The sleeve 78 must be removed from over the pins 74 before the nuts 72 can be rotated in an unloosening direction.

It will be appreciated that the components of the fan which are disassembled during shipping, for instance the electric motor 10, the blade, the guard 28, and the components of the floor supported column or the bracket 66, can all be assembled in an operational manner by the tightening of the illustrated thumb and finger wing nuts and wing screws, and no wrenches are required to assemble the fan components in an operational manner.

It is appreciated that various modifications to the inventive concepts may be apparent to those skilled in the art without departing from the spirit and scope of the invention.

What is claimed is:

1. An air circulating fan characterized by the ability to assemble major components thereof without the use of tools comprising, in combination, an electric motor having a front end and a threaded output shaft extending from said front end, a plurality of threaded elements mounted on said motor front end, a blade safety grill comprising selectively opened and closed halves, thumb operated screw fastener members cooperating with said threaded elements mounting said grill to said motor front end, a thumb operated screw nut mounted on said motor output shaft for affixing an air moving blade thereon, a fan support having a flat upper end defining a bearing surface, a flat ear defined on said electric motor, a first hole extending through said bearing surface, a second hole extending through said ear, an elongated threaded fastener extending through said first and second holes, a thumb operated nut threaded on said elongated fasteners causing said ear to frictionally engage said bearing surface mounting said motor upon said fan support for selective adjustment about said threaded fastener, a clamp mounted on said support including a U-bolt encircling said support having threaded ends, a nut threaded upon each U-bolts threaded end, an elongated finger operated pin extending through each of said nuts, and a removable connector interconnecting the pins of said nuts to prevent rotation of said nuts during normal operation of said electric motor.

2. In an air circulating fan as in claim 1, said threaded elements comprising threaded elongated studs and said thumb operated screw fastener members comprising wing nuts.

3. In an air circulating fan as in claim 1, said removable connector comprising a tubular sleeve firmly mounted on the pins of said nuts upon said pins being substantially longitudinally aligned.

4. In an air circulating fan as in claim 3, said sleeve being formed of a synthetic elastomeric material.

* * * * *